United States Patent [19]

Cats

[11] Patent Number: 4,657,163

[45] Date of Patent: Apr. 14, 1987

[54] DESK CLAMPING DEVICE OR DECOLLATOR FOR TEARING OFF STRIP SIDE EDGES

[75] Inventor: Pier C. M. Cats, Vreeland, Netherlands

[73] Assignee: Idetra B.V., Vreeland, Netherlands

[21] Appl. No.: 764,129

[22] Filed: Aug. 9, 1985

[30] Foreign Application Priority Data

Aug. 9, 1984 [NL] Netherlands ..... 8402464

[51] Int. Cl.[4] ..... B26F 3/02

[52] U.S. Cl. ..... 225/106; 225/1

[58] Field of Search ..... 225/1, 101, 106

[56] References Cited

U.S. PATENT DOCUMENTS

| | | | |
|---|---|---|---|
| 2,579,835 | 12/1951 | Lather | 225/101 |
| 2,711,793 | 6/1955 | Zalkind | 225/101 |
| 2,812,567 | 11/1957 | Zalkind | 225/101 |
| 3,190,516 | 6/1965 | Eriksen | 225/101 |
| 3,706,405 | 12/1972 | Meyer | 225/106 X |
| 4,529,113 | 7/1985 | Elliott | 225/1 |

FOREIGN PATENT DOCUMENTS

| | | | |
|---|---|---|---|
| 1937 | 3/1900 | Austria | 225/106 |

*Primary Examiner*—Frank T. Yost

*Attorney, Agent, or Firm*—Fleit, Jacobson, Cohn & Price

[57] ABSTRACT

The transport edges of a limited number of computer print sheets can be easily and manually torn off from a set or pile of form papers, especially the transporting margins of chain forms, having perforated margins provided with perforated holes engageable for paper transport. A desk clamping device consists of an oblong ruler shaped bottom bar, provided with one or more guiding stop elements to receive the perforated form margin, as well as another ruler shaped upper bar, being hingedly connected with the bottom bar. One longitudinal marginal side of the bottom bar can be moved in an upward direction, manually, this bottom bar being furthermore provided with means to bring the said longitudinal margin in a position opposite to and pressed against the bottom bar sharply and in a rectilinear way for locking such form margins simultaneously. Thereafter the form edges are torn off by means of a single tearing off movement, whereby the existing perforation or tearing line of the form sheet is followed.

6 Claims, 17 Drawing Figures

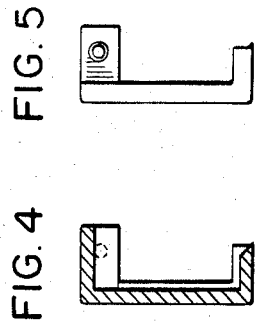
FIG. 5
FIG. 4
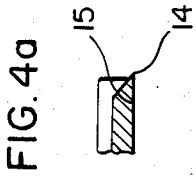
FIG. 4a
15
14
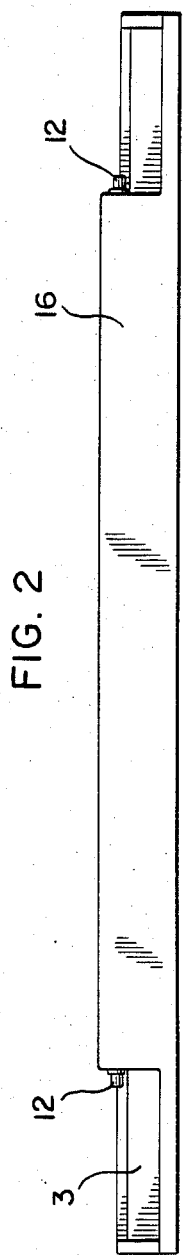
FIG. 2
12
16
12
3
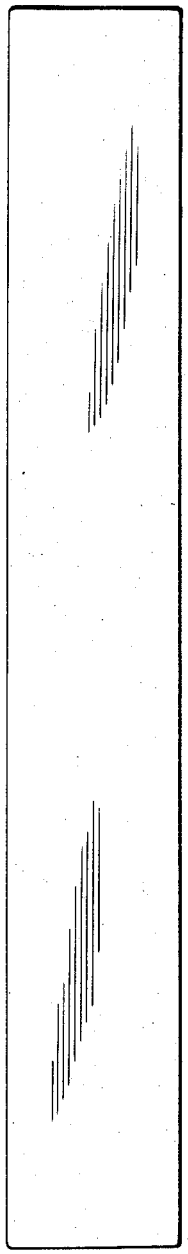
FIG. 3
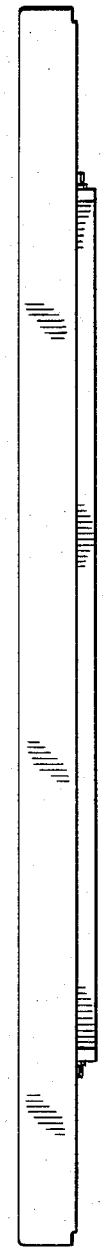
FIG. 6
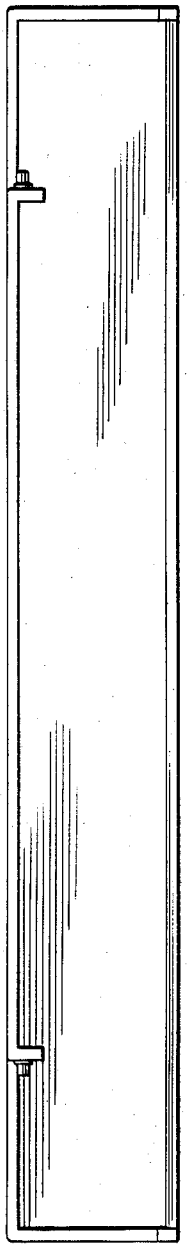
FIG. 7

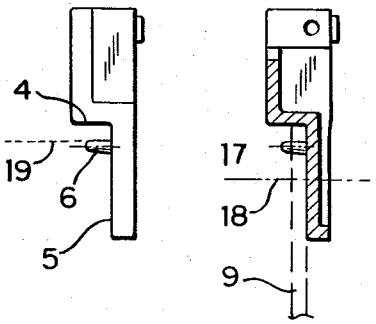
FIG. 11
FIG. 10
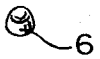
FIG. 14a
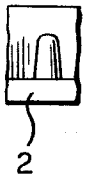
FIG. 14b
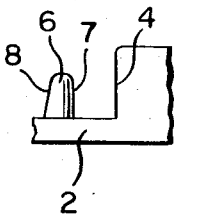
FIG. 14c
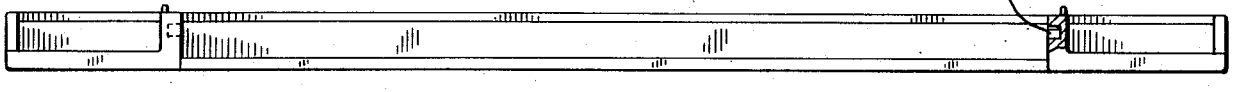
FIG. 8
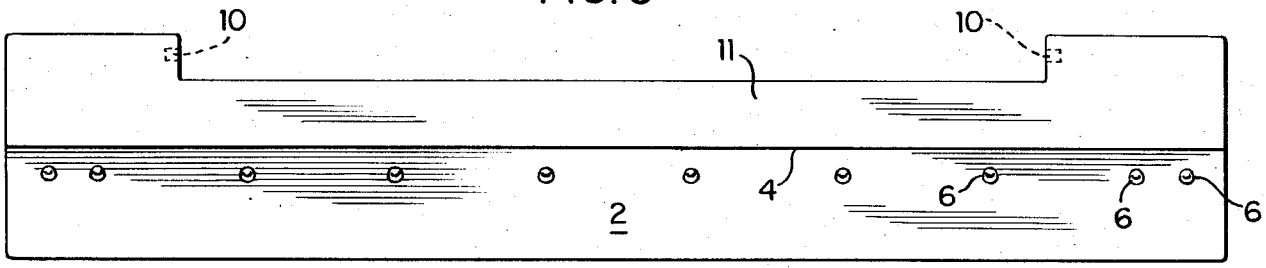
FIG. 9
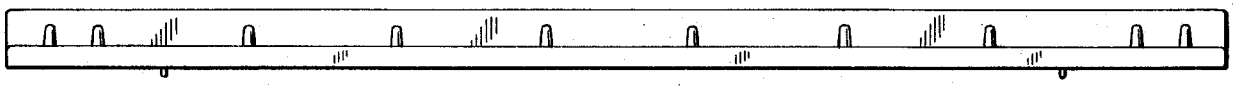
FIG. 12
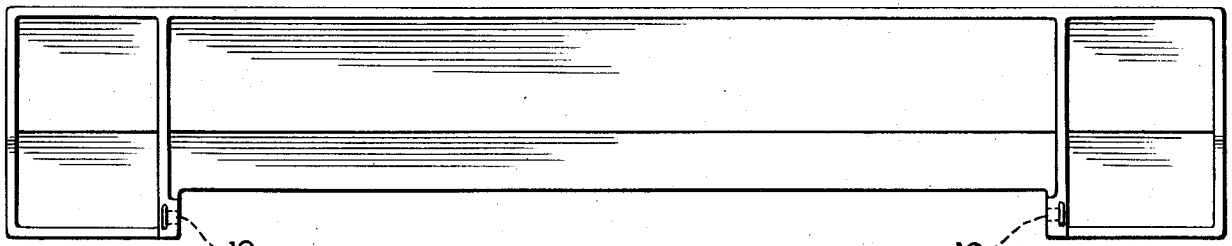
FIG. 13

DESK CLAMPING DEVICE OR DECOLLATOR FOR TEARING OFF STRIP SIDE EDGES

The invention relates to a so-called mini office decollator for computer form sets, suited for manual operation. Conventional decollator mechanically separate side edges of computer forms and such motor driven devices are relatively large and expensive. When it is necessary to separate side edges from a few number of computer forms. There are presently no other means than using e.g. a carving-knife, or often one tears off the side edges one by one along a sharp desk edge or anything similar, hoping for perfect results. The latter does not always come true, so that after all one has to check the usually small set of forms to tear off remaining imperfections.

For a small quantity of forms, the described fault can be remedied and the invention provides for a desk clamping device to be used at a limited number of sheets for manually tearing off a transport margin strip or edge slip or a similar single or plural margin of a set of form papers, especially the transporting margin strip of a chain form, provided with at least one perforated margin provided with perforated holes enageable for transport pins, which device consists of an oblong ruler-shaped bottom bar, provided with one or more guiding stop elements to receive the perforated form margin, as well as another ruler-shaped upper bar, being connected with the bottom bar and of which at least one longitudinal marginal side can be moved in an upward direction, with respect to the bottom bar, preferably by manual control and whereas furthermore the bottom bar is provided with means to bring the said longitudinal margin opposite to and pressed against the bottom bar sharply and on a rectilinear way, in which case one or more form margins are locked in simulteanously, for the purpose of tearing off the edge of one or more forms with a single tearing off movement, thereby precisely following the existing perforation or tearing line of the form sheet. Such a decollator can be easily operated by both left- and righthanded persons resulting in a perfect tearing line, in contrast with the fixed and motor-driven device. The linear-shaped device can also easily find its place on the office desk, where its use is normally required, just like e.g. a stapler or a perforating machine.

Preferably the connection between the bottom bar and the upper bar is formed by a hinge joint, which is located opposite to the side for interiors of the form. For this reason it becomes possible to provide for a flat device, the width of which allows for holding it easily on one's hands and moreover which device shows its effectiveness if the bottom and/or the upper bar respectively are provided with a number of stopper elements, particularly a number of stopping pins, which are located in such a way as to with correspond the location of a limited number of the transport pins. For positioning of the paper edge there is provided a paper stop, the risk of slipping away of the paper sheets from under the pressed down upper ruler is prevented by positioning the perforations in the paper edges over extra guiding elements, shaped as conventional transport pins, which by their special shape can easily fit the hole perforations of the paper edges.

As far as it is desirable to get rid of the paper edges, which after tearing off remain on the transport pins of the device, the invention provides for the hinge joint being constructed in such a manner, that the bottom bar and the upper bar respectively are at an angle of about 180° when the device is in a fully open position. Furthermore it is important that the initial tearing along the paper sheet perforation is performed correctly and according to the invention said longitudinal side, which preferably shows a very slight curve, starting from each end of the upper bar to the middle of the upper ruler, serves to facilitate the initial tearing off of the margin on edge for left-handed and right-handed persons respectively. It is obvious that perfect separation of the paper edge is promoted to a great extent by the construction of the edge, along which the tearing off operation takes place, for which purpose the said longitudinal side is wedge-shaped and having an acute wedge-angle of 15° to 85°.The invention meets the wish of easy handling in that there is an oblong groove provided at the bottom side of the bottom bar, which allows placing and positioning of one or more fingers, whichever the position of the upper bar is with regard to the bottom bar.

The oblong ruler-shaped bottom and upper bar can be made of metal or synthetic material preferably, and every thinkable hinge joint connection can be applied when using hard synthetic material at the bottom and upper bar in order to secure a correct tearing off operation. It is, according to the invention, nevertheless possible, to construct the hinge joint between the bottom- and upper bar in a very advanteagous manner by using a conventional, profiled hinge joint made of synthetic material, particularly of polypropylene material. In addition, it may be desirable, for reasons of easy operation, to provide the bottom part of the bottom bar with one or more adhesive strip elements for fastening the device onto an office desk top.

The invention will be explained further by means of the drawing of a preferred embodiment.

FIGS. 2–7 show a rear view, a top view and a side view respectively, in partial cross-section, front view and bottom view respectively, of the upper bar;

FIGS. 8–13 show the same views of the bottom bar;

FIG. 14 shows schematically a transport pin positioned on the bottom bar.

Figure 1:
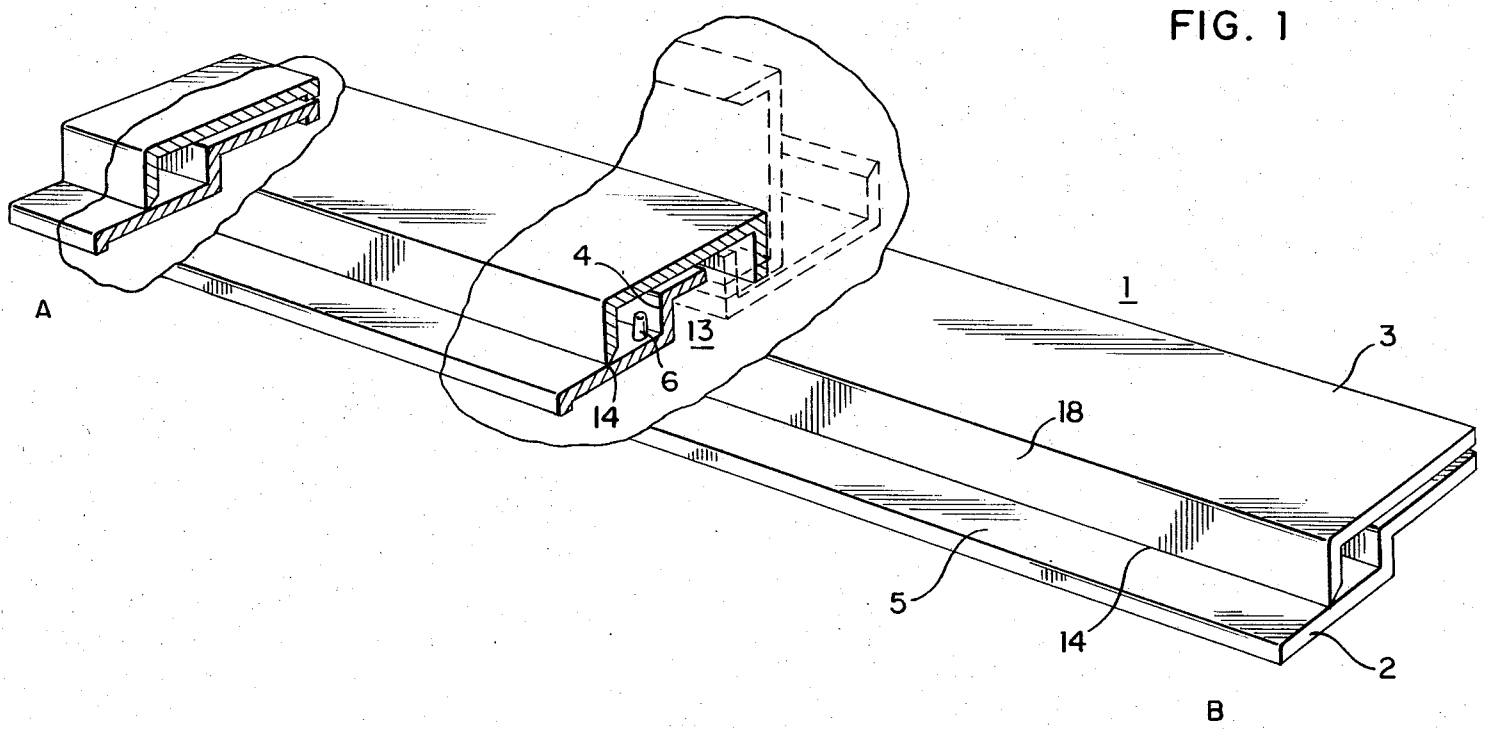
FIG. 1 shows a perspective view of the tearing device according to the invention, partially in a cross-sectional view in a closed, 90° open and 180° open position of the upper bar respectively.

In the figures the tearing device 1 is formed by an oblong ruler-shaped, profiled bottom bar 2 and a similarly ruler-shaped, profiled upper bar 3, which are obtained by means of injection moulding, for example. The bottom bar 2 is provided with an upstanding positioned guide edge 4 and upstanding stop pins 6 are provided on the flat portion 5 which pins serve to take on the side edges of computer forms already provided with hole perforations. Shape and embodiment of the pins 6 are shown in greater detail in FIG. 14, from which appears that the pin is partly cylindrical at 7 and partly tapering at 8, which shape facilitates the positioning of the paper side edge. In order to drill the relevant holes in the mould, a tapering bit can be used which corresponds to the tapering pins. The position of the pin with regard to the bottom bar is such that a descriptive line 19, running through the top of the imaginary pin cone, is perpendicular to the flat portion 5. The length of the pins 6, of which each two adjacent ones are located near the extreme ends of the bottom bar 2, depends on the desired, optimal pile of paper side edges 9 to be torn off. The bottom bar 2 is provided with a pair of recesses in order to form a hinge joint connection with the upper bar 3, for which purpose a recess 11 is provides. The upper bar 3 contains a similar pair of protrusions 12, which have such a diameter and length that the hinge joint connection is effected by means of a snap-fastening operation, for example. It can be seen from FIG. 1 that in case the upper bar 3 is completely open, there always remains an oblong recess or a groove, which allows the introduction of one or more fingers, so that manual operation of the device is facilitated and closing or opening it does not result in jamming one's fingers. In FIG. 4 the pressing edge 14 is shown in detail in a cross-section at a wedge angle of about 45°. The size of the wedge angle also depends on the kind of material used for the bar on the extent of wear to which such material is exposed. In general, a wedge angle of between 15° and 85° is used. FIG. 2 shows that the length of part 16 of the upper bar 3 approximately corresponds with the length of the recess 11 at the bottom bar 2 and thus the hinge joint action between the protrusions 12 and the holes 10 becomes effective.

The operation of the device 1 is as follows. A pile of paper forms is positioned over the transport/guiding stop pins 6 with its hole perforations when the upper bar 3 is in open position as in FIG. 1. The extreme paper side edge then lies almost against the paper guiding stop edge 4. The pre-perforated longitudinal edge of the paper sheet to be separated is then resting on the flat part 5 of the bottom bar. Furthermore the upper bar 3 with its sharp edge 14 which does not show a wedge angle at either end, see FIG. 5, as it exceeds the paper sheet edge, is pressed down firmly on the paper line perforation 17 in FIG. 11, after which the paper side edges are separated from the sheets by a quick tearing off operation, parallel to the oblong plane 18 of the upper bar 3. In order to start a correct initial tearing operation, the sharp edge 14 can slightly and symmetrically be curved in an upward direction from A to B in FIG. 1 so that the greatest pressure force concentrates at the extreme ends. The embodiment of the device as in FIG. 1–14 is merely a possible example, without leaving the inventive idea; several constructional modifications can be made having a similar effective action.

In addition the flat portion 5 in the shown embodiment protrudes considerably past the shape edge 14. This is done in order to give horizontal support to a pile of forms to be separated, so that the paper side edges will not easily slide off the tapering pins, which would otherwise hinder a quick and effective action.

I claim:

1. A device for tearing the margins off a stack of edge driven continuous feed pages of the type having a central area, on which writing is placed, divided from the margin by a perforate line, the margin engaging by means of perforated openings, transport pins of a drive mechanism, said device comprising:

a bottom bar, an upper bar, mounting means for mounting the bottom bar and upper bar for pivotal movement about an axis between an open position in which the bottom bar and upper bar define an acute angle and a closed position in which the bottom bar and upper bar substantially overlie, guiding stop means located on the bottom bar and extending in the direction of the axis for engaging an edge of the stack of pages and for positioning the perforate line at a predetermined distance from the axis, a plurality of stopper elements arranged in a row upon the bottom bar and protruding therefrom, said plurality of stopper elements being spaced apart in a direction of the axis along a line corresponding to the arrangement of the perforated transport pin openings in the margins of the pages, and a rib on the upper bar having a sharp ending rib portion protruding in a direction toward said bottom bar in said closed position, said rib extending substantially parallel to said guiding stop means and being aligned substantially along said predetermined distance from the axis to engage the perforate line in said closed position for tearing the central area from the margins of the stack of the pages.

2. A device according to claim 1, wherein each stopper element includes a half cylindrical portion and a half tapering portion, said tapering portion being directed away from said guiding stop means.

3. A device according to claim 1, wherein said rib portion includes a very slight curve starting from each end of said upper bar and curving to a middle portion of said upper bar to facilitate initial tearing off of the margins for both left-handed and right-handed persons.

4. A device according to claim 1, wherein a longitudinal edge of said rib portion is wedged-shaped, having an angle in the range of 15° to 85°.

5. A device according to claim 1, wherein an oblong groove is provided at a bottom side of said bottom bar for placing and positioning of one or more fingers.

6. A device according to claim 1, wherein a hinge joint connects said bottom bar and said upper bar, said hinge joint formed by a profiled synthetic hinge joint, made of polyproplylene.

* * * * *